US007922024B2

(12) United States Patent
Yang et al.

(10) Patent No.: US 7,922,024 B2
(45) **Date of Patent: *Apr. 12, 2011**

(54) RECEPTACLE WITH MOTION DAMPER FOR LID

(75) Inventors: Frank Yang, Rancho Palos Verdes, CA (US); Joseph Sandor, Santa Ana Heights, CA (US)

(73) Assignee: simplehuman, LLC, Torrance, CA (US)

( * ) Notice: Subject to any disclaimer, the term of this patent is extended or adjusted under 35 U.S.C. 154(b) by 507 days.

This patent is subject to a terminal disclaimer.

(21) Appl. No.: 11/475,349

(22) Filed: Jun. 27, 2006

(65) Prior Publication Data

US 2007/0012699 A1 Jan. 18, 2007

Related U.S. Application Data

(63) Continuation-in-part of application No. 11/086,932, filed on Mar. 22, 2005, now Pat. No. 7,494,021.

(51) Int. Cl.
*B65D 43/26* (2006.01)
*B65D 21/02* (2006.01)
*B65D 51/04* (2006.01)

(52) U.S. Cl. ..... 220/264; 220/263; 220/908; 220/23.83; 220/810

(58) Field of Classification Search ..... 220/264, 220/263, 908, 23.87, 810, 845, 23.83, 827, 220/828, 495.01, 495.06
See application file for complete search history.

(56) References Cited

U.S. PATENT DOCUMENTS 1,426,211 A 8/1922 Pausin
1,820,555 A 8/1931 Buschman
1,891,651 A 12/1932 Padelford et al.
1,980,938 A * 11/1934 Geibel ..... 220/23.87
2,759,625 A 8/1956 Ritter
2,888,307 A 5/1959 Graves et al.
2,946,474 A 7/1960 Knapp
3,008,604 A 11/1961 Garner
3,023,922 A 3/1962 Arrington et al.
3,654,534 A 4/1972 Fischer
3,891,115 A 6/1975 Ono (Continued)

FOREIGN PATENT DOCUMENTS

AU 622536 4/1992

(Continued)

OTHER PUBLICATIONS

U.S. District Court Civil Docket for *Simplehuman, LLC*, v. *Conair Corporation and Lifetime Brands, Inc.*, Filed in Case No. CV 09-1373-DSF-AJW.

(Continued)

*Primary Examiner* — Robin Hylton

(74) *Attorney, Agent, or Firm* — Knobbe, Martens, Olson & Bear LLP

(57) ABSTRACT

A receptacle having a lid or door can be provided with a damper configured to slow the movement of the lid or door from the open position to its closed position. As such, the lid closes in a more aesthetically pleasing manner, for example, closing slowly enough so that it does not create an excessively loud noise when it closes. Additionally, the damper can be mounted to the base of the receptacle, thereby more securely mounting the damper within the receptacle. Additionally, the damper can be arranged to allow a liner within the receptacle to be held in an elevated position for simplifying a process of inserting or removing a trash bag into the liner.

22 Claims, 12 Drawing Sheets

U.S. PATENT DOCUMENTS

| | | | | |
|---|---|---|---|---|
| 4,014,457 | A | 3/1977 | Hodge | |
| 4,081,105 | A | 3/1978 | Dagonnet et al. | |
| 4,200,197 | A | 4/1980 | Meyer et al. | |
| 4,303,174 | A | 12/1981 | Anderson | |
| 4,320,851 | A | 3/1982 | Montoya | |
| 4,416,197 | A | 11/1983 | Kehl | |
| D284,320 | S | 6/1986 | Kubic et al. | |
| 4,630,332 | A | 12/1986 | Bisbing | |
| 4,711,161 | A | 12/1987 | Swin et al. | |
| 4,753,367 | A | 6/1988 | Miller et al. | |
| 4,765,548 | A | 8/1988 | Sing | |
| 4,765,579 | A | 8/1988 | Robbins et al. | |
| 4,792,039 | A | 12/1988 | Dayton | |
| 4,913,308 | A | 4/1990 | Culbertson | |
| 4,918,568 | A | 4/1990 | Stone et al. | |
| 4,948,004 | A | 8/1990 | Chich | |
| 4,972,966 | A | 11/1990 | Craft, Jr. | |
| 5,065,272 | A | 11/1991 | Owen et al. | |
| 5,090,785 | A | 2/1992 | Stamp | |
| 5,111,958 | A | 5/1992 | Witthoeft | |
| D327,760 | S | 7/1992 | Donnelly | |
| 5,147,055 | A | 9/1992 | Sampson et al. | |
| 5,170,904 | A | 12/1992 | Neuhaus | |
| 5,174,462 | A | 12/1992 | Hames | |
| 5,213,272 | A | 5/1993 | Gallagher et al. | |
| 5,226,558 | A | 7/1993 | Whitney et al. | |
| 5,230,525 | A | 7/1993 | Delmerico et al. | |
| D340,333 | S | 10/1993 | Duran et al. | |
| 5,249,693 | A | 10/1993 | Gillispie et al. | |
| 5,322,179 | A | 6/1994 | Ting | |
| 5,348,222 | A | 9/1994 | Patey | |
| 5,385,258 | A | 1/1995 | Sutherlin | |
| 5,390,818 | A | 2/1995 | LaBuda | |
| 5,407,089 | A | 4/1995 | Bird et al. | |
| 5,471,708 | A | 12/1995 | Lynch | |
| 5,474,201 | A | 12/1995 | Liu | |
| 5,531,348 | A | 7/1996 | Baker et al. | |
| 5,558,254 | A | 9/1996 | Anderson et al. | |
| D377,554 | S | 1/1997 | Adriaansen | |
| 5,662,235 | A | 9/1997 | Nieto | |
| 5,699,929 | A | 12/1997 | Ouno | |
| 5,799,909 | A | 9/1998 | Ziegler | |
| 5,816,640 | A | 10/1998 | Nishimura | |
| 5,881,896 | A | 3/1999 | Presnell et al. | |
| 5,967,392 | A | 10/1999 | Niemi et al. | |
| 6,000,569 | A | 12/1999 | Liu | |
| 6,010,024 | A | 1/2000 | Wang | |
| 6,024,238 | A | 2/2000 | Jaros | |
| 6,036,050 | A | 3/2000 | Ruane | |
| D435,951 | S | 1/2001 | Yang et al. | |
| 6,209,744 | B1 | 4/2001 | Gill | |
| 6,250,492 | B1 | 6/2001 | Verbeek | |
| 6,328,320 | B1 | 12/2001 | Walski et al. | |
| 6,364,147 | B1 | 4/2002 | Meinzinger et al. | |
| 6,386,386 | B1 | 5/2002 | George | |
| 6,390,321 | B1 | 5/2002 | Wang | |
| 6,401,958 | B1 | 6/2002 | Foss et al. | |
| 6,626,316 | B2 | 9/2003 | Yang | |
| 6,626,317 | B2 | 9/2003 | Pfiefer et al. | |
| D488,604 | S | 4/2004 | Yang et al. | |
| D489,857 | S | 5/2004 | Yang et al. | |
| D490,583 | S | 5/2004 | Yang et al. | |
| D490,954 | S | 6/2004 | Brand | |
| D491,706 | S | 6/2004 | Yang et al. | |
| D493,930 | S | 8/2004 | Wang | |
| D494,723 | S | 8/2004 | Lin | |
| 6,837,393 | B1 | 1/2005 | Kuo | |
| 6,883,676 | B2 * | 4/2005 | Lin | 220/263 |
| D507,090 | S | 7/2005 | Yang et al. | |
| 6,920,994 | B2 * | 7/2005 | Lin | 220/264 |
| 6,981,606 | B2 | 1/2006 | Yang et al. | |
| D517,764 | S | 3/2006 | Wang | |
| D518,266 | S | 3/2006 | Yang et al. | |
| 7,017,773 | B2 | 3/2006 | Gruber et al. | |
| D525,756 | S | 7/2006 | Yang et al. | |
| 7,077,283 | B2 | 7/2006 | Yang et al. | |
| 7,086,550 | B2 | 8/2006 | Yang et al. | |
| 7,121,421 | B2 | 10/2006 | Yang et al. | |
| D535,800 | S | 1/2007 | Yang et al. | |
| D537,223 | S | 2/2007 | Lin | |
| D537,599 | S | 2/2007 | Lin | |
| D537,601 | S | 2/2007 | Lin | |
| D538,995 | S | 3/2007 | Lin | |
| D539,499 | S | 3/2007 | Yang et al. | |
| D542,001 | S | 5/2007 | Yang et al | |
| D544,170 | S | 6/2007 | Lin | |
| D544,171 | S | 6/2007 | Lin | |
| D545,024 | S | 6/2007 | Liao | |
| D547,020 | S | 7/2007 | Chen | |
| 7,494,021 | B2 | 2/2009 | Yang et al. | |
| 2002/0079315 | A1 | 6/2002 | Yang | |
| 2003/0201267 | A1 | 10/2003 | Yang et al. | |
| 2004/0164077 | A1 * | 8/2004 | Kuo | 220/263 |
| 2005/0103788 | A1 | 5/2005 | Yang et al. | |
| 2006/0213910 | A1 * | 9/2006 | Yang et al. | 220/264 |
| 2006/0249510 | A1 | 11/2006 | Lin | |

FOREIGN PATENT DOCUMENTS

| | | |
|---|---|---|
| DE | 1610087 | 7/1950 |
| DE | 1283741 | 7/1966 |
| DE | 8436939 | 3/1985 |
| EP | 1094017 | 4/2001 |
| EP | 1361176 | 11/2003 |
| EP | 1136393 | 4/2004 |
| JP | 02-152670 | 6/1990 |
| JP | 06-272888 | 9/1994 |
| NL | 6908550 | 12/1970 |
| WO | WO 92/02430 | 2/1992 |

OTHER PUBLICATIONS

First Amended Complaint for Patent Infringement, Filed in Case No. CV 09-1373-DSF-AJW, *Simplehuman, LLC*, v. *Conair Corporation and Lifetime Brands, Inc.*, dated Mar. 17, 2009.

Complaint for Patent Infringement, Filed in Case No. CV09-1373-DSF-AJW, *Simplehuman, LLC*, v. *Cuisinart Corporation, Lifetime Brands, Inc.* and *M. Kamenstein, Inc.*, dated Feb. 26, 2009.

Trento Corner 23 Trash Can, Hailo product brochure, http://www.hailo.de/html/default.asp?site=12_71_107&lang=en.

European Search Report for European Application No. EP 06010394, dated Aug. 24, 2006, in 1 page.

Partial European Search Report for Application No. EP 10002273, dated Jul. 2, 2010, in 4 pages.

* cited by examiner

RECEPTACLE WITH MOTION DAMPER FOR LID

PRIORITY INFORMATION

The present application is a continuation-in-part of U.S. patent application Ser. No. 11/086,932 filed Mar. 22, 2005 now U.S. Pat. No. 7,494,021, the entire contents of which is hereby expressly incorporated by reference.

BACKGROUND OF THE INVENTIONS

1. Field of the Inventions

The present inventions relate to receptacles having doors or lids, the motion of which is affected by a mechanism configured to slow at least the closing movement of the lid or door.

2. Description of the Related Art

Receptacles and other devices having lids or doors are used in a variety of different settings. For example, in both residential and commercial settings, trash cans and other devices often have lids or doors for protecting or preventing the escape of the contents of the receptacle. In the context of trash cans, some trash cans include lids or doors to prevent odors from escaping and to hide the trash within the receptacle from view. Additionally, the lid of a trash can help prevent contamination from escaping from the receptacle.

Recently, trash cans with rotary-type motion dampers for slowing the motion of the lids have become commercially available. More specifically, these rotary dampening mechanisms are connected to the lids of the trash cans so as to slow the closing movement of the lids. As such, the trash can is more aesthetically pleasing because the lid closes slowly, thereby preventing a loud slamming noise when the lid is moved to a closing position.

These types of trash cans often are pedal-actuated, i.e., they include a foot pedal which is connected to the lid for moving the lid toward the open position. The rotary mechanisms are connected to the internal linkage connecting the foot pedal to the lid so as to slow the closing movement of the lid.

SUMMARY OF THE INVENTIONS

An aspect of at least one of the embodiments disclosed herein includes the realization that although fluid damper mechanisms provide consistent and quiet dampening effects for the lids of receptacles such as trash cans, such fluid dampers can generate high reaction forces. Thus, mounting a fluid damper to a lower portion of a receptacle improves the rigidity of the mechanism and thus simplifies the design and manufacture of such a receptacle because the need to stiffen the mount of the damper is reduced.

Thus, in accordance with an embodiment, a receptacle assembly having a lid can comprise a receptacle body member defining a cavity configured to contain objects, the cavity including an opening. A lower portion can be configured to support the receptacle body on a floor and a lid can be mounted relative to the opening and configured to be moveable between open and closed positions. A lid operation mechanism can be configured to allow a user to move the lid between the open and closed positions. The lid operation mechanism can comprise a user input member mechanically interfaced with the lid so as to allow a user to at least open the lid through manipulation of the user input member. Additionally, the receptacle can include a fluid damper mechanism configured to dampen the movement of the lid from the open position to the closed position, the damper mechanism being mounted on the lower portion.

In accordance with another embodiment, a receptacle assembly having a lid can comprise a receptacle body member defining a cavity configured to contain objects, the cavity including an opening. A lower portion can be configured to support the receptacle body on a floor, and a lid can be mounted relative to the opening and configured to be moveable between open and closed positions. A lid operation mechanism can be configured to allow a user to move the lid between the open and closed positions, and can comprise a user input member mechanically interfaced with the lid so as to allow a user to at least open the lid through manipulation of the user input member. Additionally, the receptacle can include means for restricting a fluid flow to dampen the movement of the lid from the open position to the closed position, and the means for dampening can be disposed on the lower portion.

Another aspect of at least one of the embodiments disclosed herein includes the realization that a damper mechanism can be configured to serve the dual purposes of dampening a movement of a portion of the receptacle and provide a support for holding a liner of the receptacle in an elevated position. For example, a portion of the fluid damper can be positioned such that a liner can be inserted into the receptacle with a portion of the liner resting on a portion of the damper such that the liner is elevated relative to another position in which the liner is fully received within the receptacle. As such, a trash bag can be more easily removed from or inserted into the liner with the liner in the elevated position, thereby eliminating the need to completely remove the liner form the receptacle. As such, the damper serves the dual purposes of dampening a motion of the lid and supporting the liner during a trash bag insertion or removal procedure.

Thus, in accordance with at least one of the embodiments disclosed herein, a receptacle assembly having a lid can comprise a receptacle body member defining a cavity, the cavity including an opening. A liner member can be configured to fit within the cavity and a lid can be mounted relative to the opening and configured to be moveable between open and closed positions. A lid operation mechanism can be configured to allow a user to move the lid between the open and closed positions. Additionally, a damper mechanism can be configured to dampen the movement of the lid from the open position to the closed position, and can comprise an upper portion configured to support the liner member in a position with an upper portion of the liner member extending through the opening.

BRIEF DESCRIPTION OF THE DRAWINGS

The above-mentioned and other features of the inventions disclosed herein are described below with reference to the drawings of preferred embodiments. The illustrated embodiments are intended to illustrate, but not to limit the inventions. The drawings contain the following Figures.

DETAILED DESCRIPTION OF THE PREFERRED EMBODIMENTS

Figure 1:
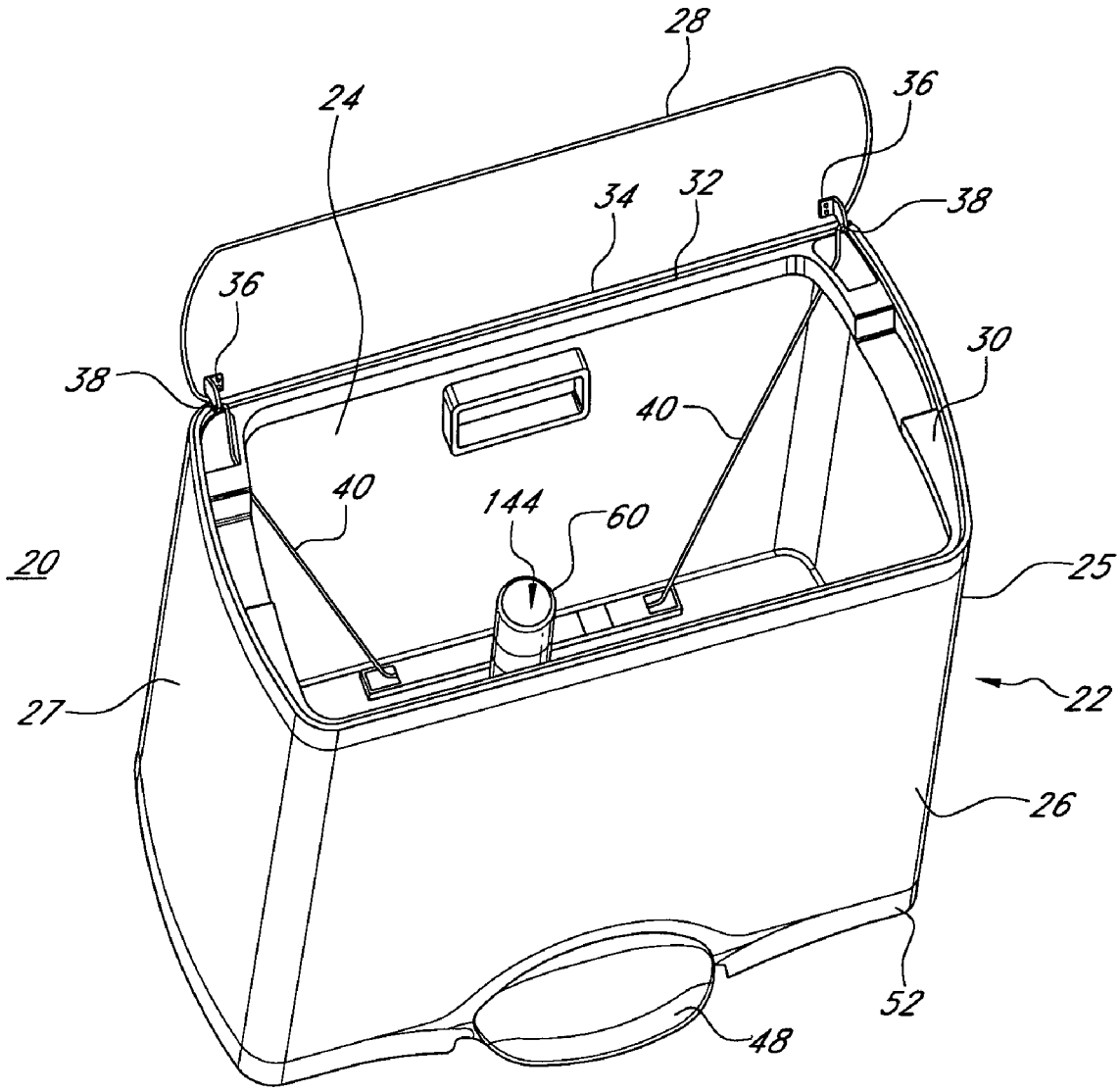
FIG. 1 is a top, front, and right side perspective view of a receptacle assembly in accordance with an embodiment, shown with its lid opened.

The embodiments of a receptacle with lid or door assembly with a dampened motion is disclosed in the context of a trash can. The inventions disclosed herein are described in the context of a trash can because they have particular utility in this context. However, the inventions disclosed herein can be used in other contexts as well, including, for example, but without limitation, large commercial trash cans, doors, windows, security gates, and other larger doors or lids, as well as doors or lids for smaller devices, such as high precision scales, computer drives, etc.

FIGS. 1-4B illustrate an embodiment of a receptacle assembly 20. The assembly can include an outer shell 22 and an inner liner 130 (FIGS. 9 and 10) adapted to be retained within the outer shell.

The outer shell 22 can be optionally supported on a base 52. An upper support frame 30 can be secured to the top of the outer shell 22. The support frame 30 can be made from the same or a different material from that used to form the outer shell. The outer shell 22 and the support frame 30 can be made from any material, such as, for example, but without limitation, aluminum, steel, stainless steel, plastics, etc. Additionally, as noted above, the frame 30 can be made from a different material from that used to form the shell 22.

The outer shell 22 can be formed in any configuration. The exemplary non-limiting embodiment illustrated in FIG. 1 includes a shell 22 having a generally four-sided rectangular configuration with a rear wall 24, a front wall 26, and two side walls 25, 27. The inner liner 130 can have generally the same or a different shape, roughly complimentary to the shape of the outer shell 22.

A lid 28 can be pivotally connected to an upper edge of the rear wall with any type of device. For example, the device for pivotally connecting the lid 28 to the shell 22 can be a hinge, such as a piano hinge, or any other device.

In the illustrated embodiment, the lid is pivotally connected to the top edge of the rear wall 24 with a shaft (not shown) that is retained inside a sleeve 32. The sleeve 32 can extend along an inner edge 34 of the lid 28. The shaft can have opposing ends that are pivotally secured to the upper support frame 30 such that the lid 28 can pivot about an axis defined by the shaft and its corresponding sleeve 32.

Two L-shaped brackets 36 can be provided on an inner surface of the lid 28 at opposite sides of the lid 28 adjacent the sleeve 32. A leg of each bracket 36 can be secured to the underside of the lid 28. The other leg of each bracket 36 can include an opening adapted to receive an upper hook-shaped end 38 of a corresponding lifting rod 40.

With reference to FIGS. 2A-4B, a foot pedal 48 can be secured to (or made in one piece with) a pedal bar 50 (e.g. a lever arm). The pedal bar 50 can be pivotally coupled to the base 52, for example, using a fulcrum rod, as is well known in the art. Such an arrangement can define a pivot axis 54 located at about the center of the pedal bar 50. In some embodiments, the pivot axis 54 can be spaced from the center of gravity of the pedal bar 50. As such, the weight of the pedal bar 50 can be used to bias the orientation of the pedal bar 50 toward a position corresponding to the closed position of the lid 28, described in greater detail below.

The pedal bar 50 can be made of any material. More preferably, the pedal bar is made from a relatively heavy member so as to provide some ballast to the receptacle 20 and/or, as noted above, a bias for the position of the pedal bar 50. However, the pedal bar 50 can be made from any material including lightweight material such as plastics, aluminum, etc.

The front of the pedal bar 50 can be connected to the foot pedal 48. The length of the pedal bar 50 can extend along the base 52, with the rear of the pedal bar 50 pivotally coupled to the lifting rods 40. The lifting rods 40 can extend upwardly from the rear end of the pedal bar 50, along the rear of the outer shell 22 and connect to the lid 28 at their upper ends, as noted above. The hooked end 38 of each lifting rod 40 is provided at the top end of the corresponding lifting rod 40 for coupling to the corresponding brackets 36.

Figure 2B:
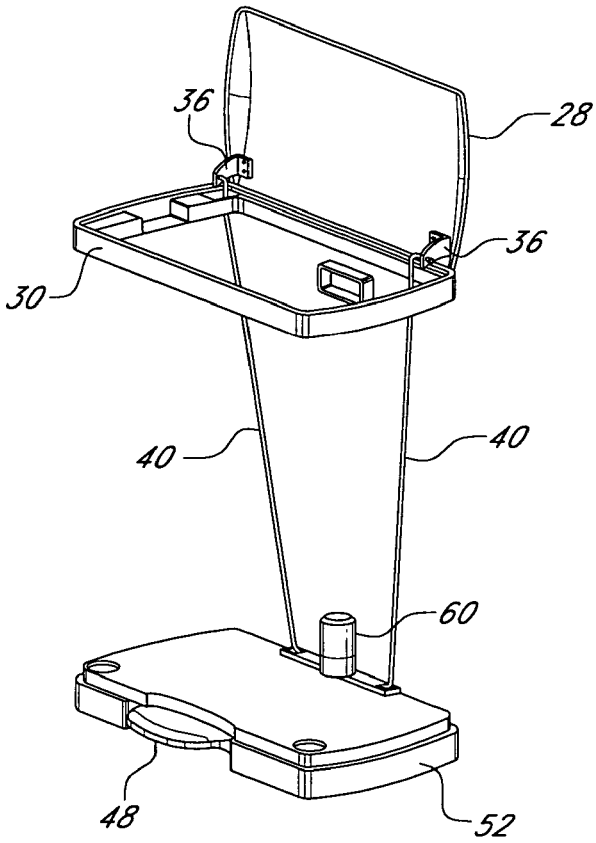
FIG. 2B is a front, top, and left side perspective view of the receptacle assembly of FIG. 2A, shown with the lid in an open position.
Figure 2A:
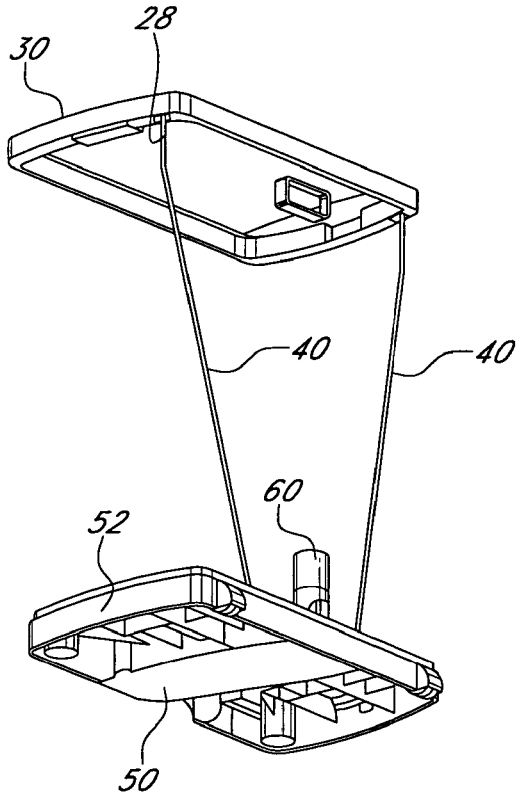
FIG. 2A is a bottom, rear, and left side perspective view of the receptacle assembly of FIG. 1, with an outer shell removed and with the lid closed.
Figure 3A:
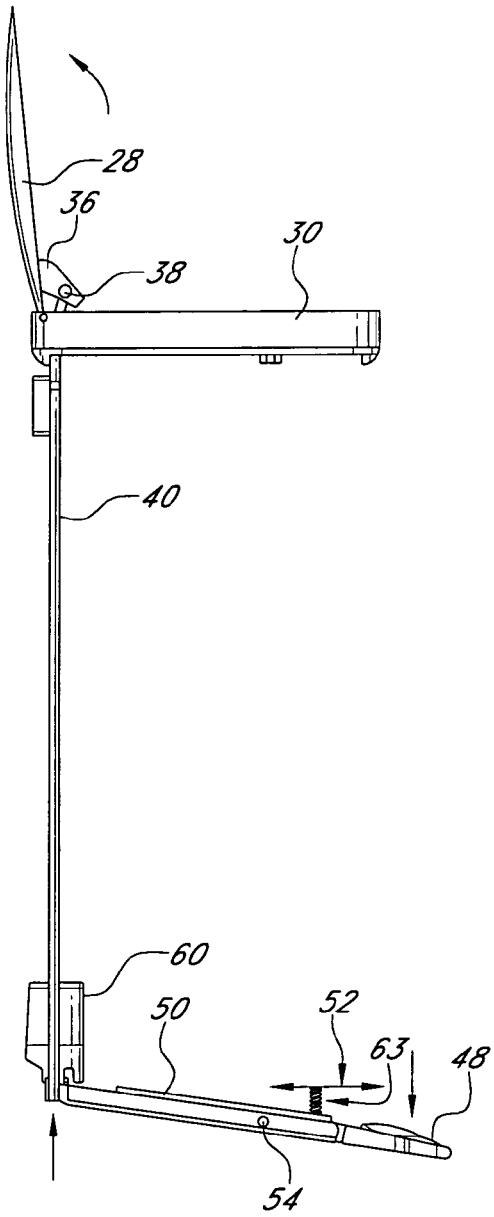
FIG. 3A is a right side elevational view of the receptacle assembly in the state shown in FIG. 2B, with a base portion removed.
Figure 3B:
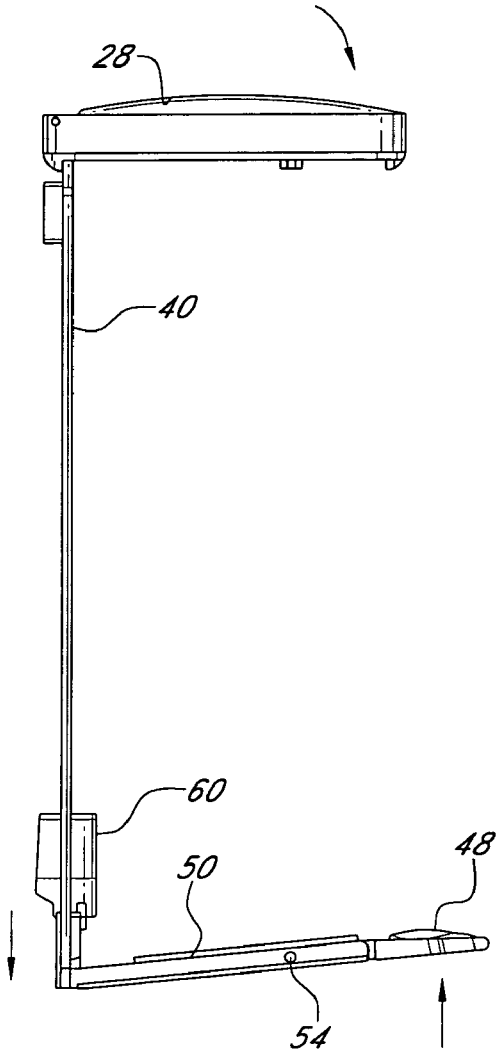
FIG. 3B is a left side elevational view of the receptacle assembly in the state shown in FIG. 2A with the base portion removed and with the lid in the closed position.

The pedal bar 50 and the lifting rods 40 transform an up and down pivot motion of the pedal 48 to an up and down pivot motion for the lid 28. For example, the pedal bar 50 can be pivoted between two positions, a first resting position as shown in FIGS. 2A and 3B and a second open position as shown in FIGS. 2B and 3A.

Figure 4A:
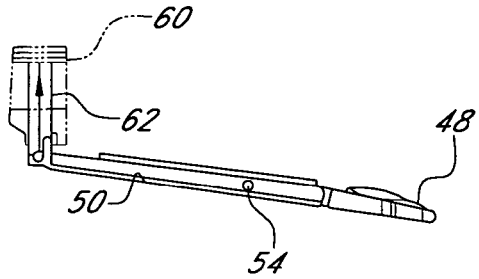
FIG. 4A is a side elevational view of a pedal and damper assembly of the receptacle assembly shown in the state illustrated in FIG. 3A and with a portion of a damper mechanism shown in phantom line.

In the resting position, the foot pedal 48 at the front of the pedal bar 50 is at a vertically higher position than the rear of the pedal bar 50. The second open position, for example, where the lid 28 has reached its maximum open position, as shown in FIGS. 2B, 3A, and 4A, can be achieved with the foot pedal 48 pressed to a vertically lower position than the rear of the pedal bar 50.

In the second opened position, the foot pedal 48 is depressed to cause the pedal bar 50 to pivot, causing the rear end of the pedal bar 50 to be raised upwardly, thereby pushing the lifting rods 40 upwardly, which thereby causes the hooked end 38 of the lifting rods 40 to push the bracket 36 upwardly. This causes the lid 28 to open.

When the foot pedal 48 is maintained in this second open position, the hooked end 38 of the lifting rods 40 continue to maintain the lid 28 in the open position. When the force on the foot pedal 48 is removed, the combined forces from the weight of the lid 28 (if applicable), the weight of the pedal bar 50 (if applicable), and gravity, push the lifting rods 40 downwardly, causing the pedal bar 50 to pivot to the first rest position. As noted above, in some embodiments, the pivot axis 54 of the pedal bar 50 can be located offset from the center of gravity of the pedal bar 50 so as to bias the lid 28 toward the closed position.

Without any device for slowing the motion of the closing of the lid 28, the lid 28 can slam shut very quickly, and thus generate a loud noise. Thus, the receptacle 20 includes a damper mechanism for slowing the downward motion of the lid 28.

With reference to FIGS. 1-4B, the damper mechanism can include a damper housing 60 secured to a rear area of the base 52 at about the center of the base 52. However, other locations can also be used.

The damper housing 60 can define a cylinder in which a damper piston can reciprocate. The dampening function of the dampening mechanism is achieved through the resistance of the flow of a fluid, such as air, into and out of the housing 60. This can generate large forces.

Thus, further advantages are achieved by mounting the housing 60 of the dampening mechanism to the base 52. For example, dampening mechanisms of other prior art trash cans have been mounted on brackets suspended above the base 52. However, mounting the housing 60 to the base 52 provides enhanced rigidity in that the housing 60 can be easily secured to the base 52 without the need for additional bracketing to maintain the stability of the housing 60.

With continued reference to FIG. 4A, when the foot pedal 48 is pressed to the position, the piston 62 inside the damper housing 60 is moved toward its uppermost position. With reference also to FIG. 3A, in the opened position, the lifting rods 40 raise the bracket 36 and the lid 28, and the rear of the pedal bar 50 is also raised with respect to the foot pedal 48 at the front of the pedal bar 40. When the rear of the pedal bar is raised, the air piston 62 is pushed upwardly inside the damper housing 60 by the rear of the pedal bar 50 (FIG. 4A).

Figure 4B:
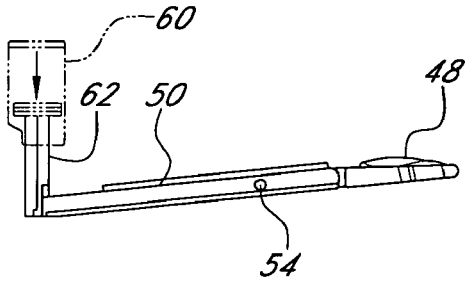
FIG. 4B is a right side elevational view of a damper and pedal mechanism of the receptacle assembly in the state illustrated in FIG. 3B.

As the force on the pedal 48 is released, the combined forces from the weight of the lid 28 (if applicable), the weight of the pedal bar 50 (if applicable), and gravity, will push the lifting rods 40 downwardly. As the lifting rods 40 move downwardly (FIG. 3B), the lifting rods 40 will push the rear of the pedal bar 50 downwardly, thereby pulling the air piston 62 downwardly within the housing 60 (FIG. 4B). However, the air piston 62 positioned inside the housing 60 opposes the immediate downward motion of the rear of the pedal bar 50, thereby slowing the downward motion of the lifting rods 40 and the lid 28.

Optionally, the receptacle assembly 20 can include a resilient member 63 (FIG. 3A) configured to aid in the closing movement of the lid 28. For example, but without limitation, the resilient member 63 can be a spring, or any other type of resilient member or device that can be configured to provide a restoring force for moving the lid 28 from its opened position toward its closed position.

In the illustrated embodiment of FIG. 3A, the resilient member 63 is in the form of a coil spring having one end connected to the pedal bar 50 and another end mounted to a portion of the base 52 (shown partially in FIG. 3A). In this arrangement, the resilient member 63 is configured to extend against its bias when the pedal bar 50 is pivoted in the direction illustrated in FIG. 3A, e.g., when a user presses the pedal 48 downwardly. As such, when the user releases the pedal 48, the resilient member 63 aids in pulling the forward end of the pedal bar 50 upwardly, thereby pulling the lid 28 towards its closed position.

However, this is merely one exemplary arrangement that can be used. The resilient member 63 can be positioned anywhere along the connection between the pedal 48 and the lid 28. For example, but without limitation, a resilient member can be connected to a portion of the lifting rods 40, the lid 28, a hinge connecting the lid 28 to the shell 22, any other place along the pedal bar 50, a portion of the damper 60, or any other location. Further, the resilient member 63, as noted above, can be in the form of any type of spring, such as leaf springs or coil springs, or any type of resilient member made from any material.

When a force is applied to the foot pedal 48, the pedal bar 50 is pivoted again to cause the rear of the pedal bar 50 to be raised, thereby raising the lifting rods 40 and the lid 28 to the open position shown in FIGS. 1, 2B, 3A, and 4A. The air piston 62 is also pushed upwardly when the rear of the pedal bar 50 is raised, but does not apply significant force to oppose its own upward motion inside the damper housing 60.

Figure 5:
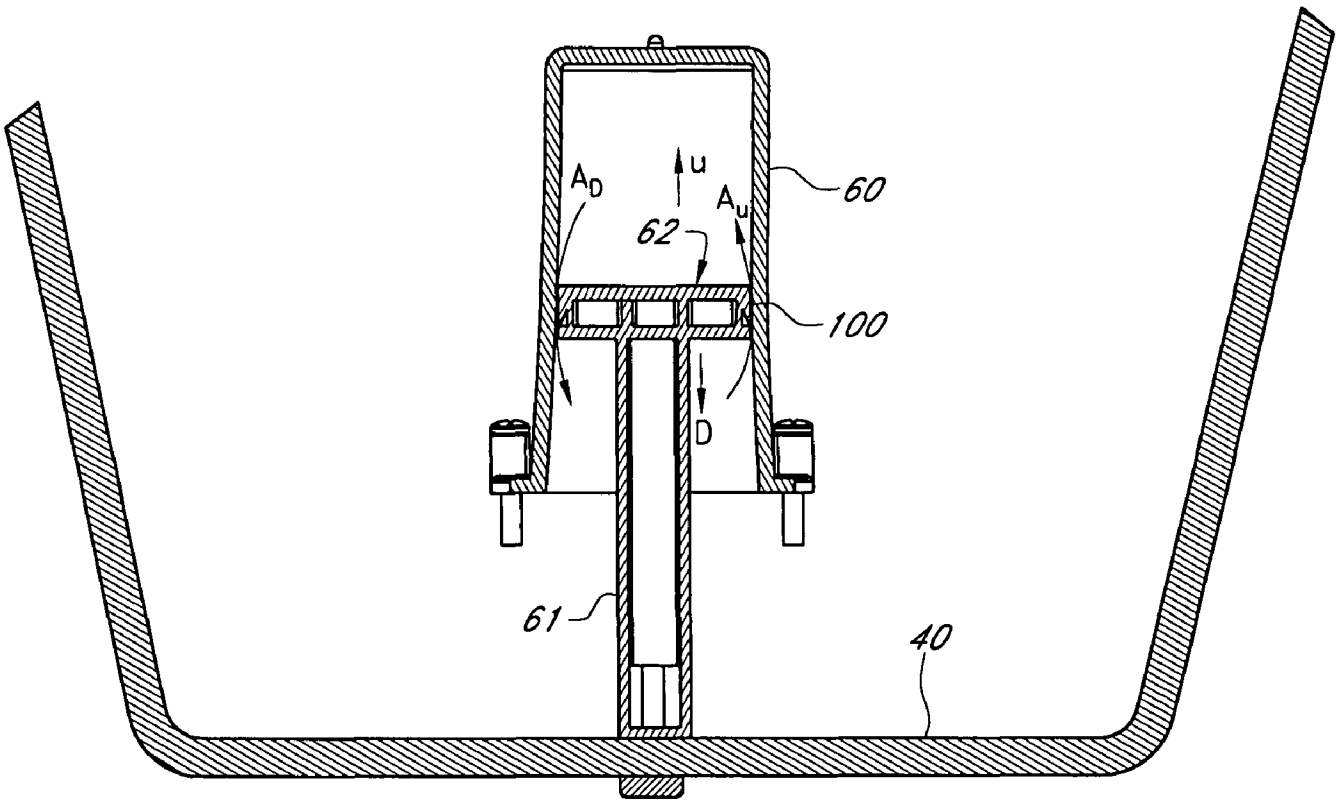
FIG. 5 is an enlarged sectional view of the damper mechanism and a portion of a link arrangement connecting the damper mechanism to the lid.

FIG. 5 illustrates an exemplary but non-limiting embodiment of the damper mechanism which includes the housing 60 and the air piston 62. As shown in FIG. 5, the air piston 62 is connected to the lifting rod 40 with a piston rod 61.

In some embodiments, the housing 60 can be made of plastic. However, the housing 60 can be made of any material.

The air piston 62 is sized to fit snugly within the inner surface of the housing 60. As noted above, the piston 62 is configured to provide little resistance to the upward movement of the piston 62 within the housing 60, but provide greater resistance against the downward movement of the piston 62 within the housing 60. This can be accomplished in any known manner.

Figure 6:
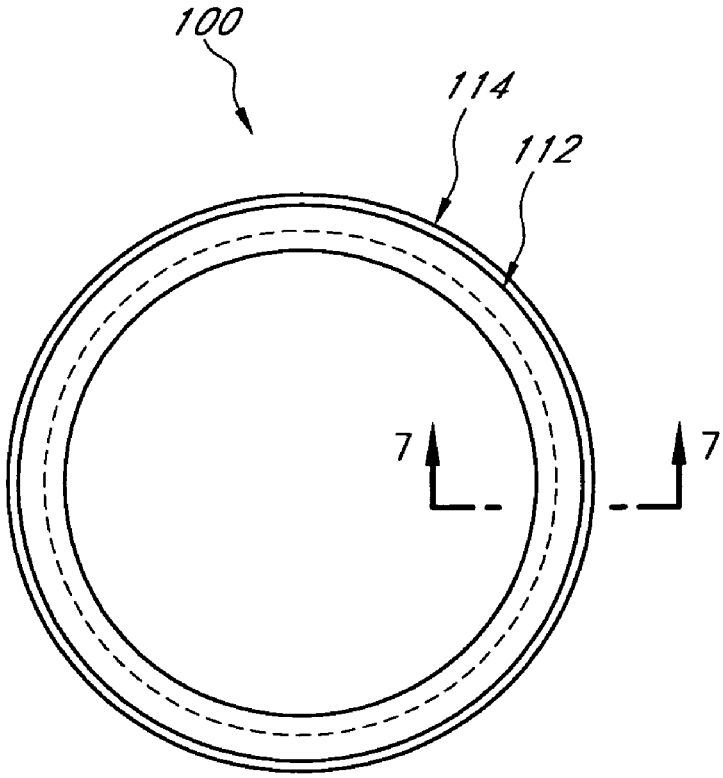
FIG. 6 is a top plan view of a lip seal that can be used with the damper illustrated in FIG. 5.
Figure 7:
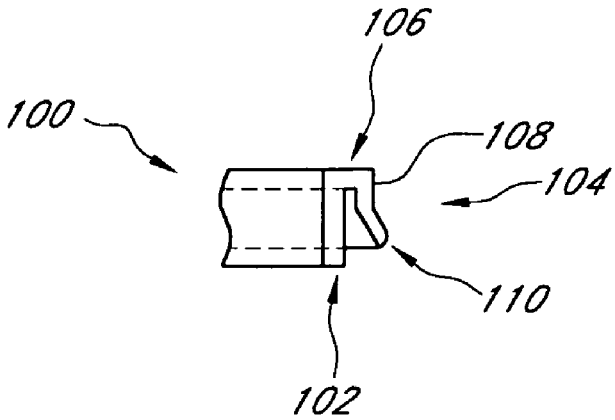
FIG. 7 is a sectional view of the lip seal of FIG. 6 taken alone line 7-7.

In the illustrated embodiment, with additional reference to FIGS. 6 and 7, the piston 62 can be provided with a lip seal 100. In some embodiments, the lip seal 100 can be configured to operate similarly to a check valve. Thus, the lip seal 100 can have any configuration that can provide a similar function.

In the illustrated embodiment, the lip seal 100 is generally annular in shape, having an inner wall 102 and an outer wall 104 connected by a top wall 106. The outer wall 104 can include an upper portion 108 that extends generally parallel to the inner wall of 102 and a projecting portion 110 that extends radially outwardly relative to the upper portion 108. As such, the outer diameter 112 defined by the upper portion 108 is slightly smaller than the diameter 114 defined by the projecting portion 110. Additionally, the ramped configuration of the projecting portion 110 relative to the upper portion 108 helps to achieve the check valve-type functionality of the lip seal 100.

For example, with reference to FIG. 5, as the piston 62 moves upwardly within the housing 60 in the direction of arrow U, air $A_D$ flows downwardly along the inner walls of the housing 60, past the projecting portion 110 of the lip seal 100. Due to the ramped shape of the projecting portion 110, the pressure generated within the upper portion of the housing above the piston 62 helps deflect the projecting portion 110 radially inwardly, thereby allowing the air A to pass thereby without generating a large resistance.

However, when the piston 62 moves downwardly within the housing 60, the air pressure in the space above the piston 62 drops, thereby causing the projecting portion 110 to further expand against the inner walls of the housing 60. This generates additional resistance to the flow of air $A_U$ into the space above the piston 62. As such, the lip seal 100 generates more resistance to the downward movement of the piston 62 than against the upward movement of the piston 62.

In some embodiments, the lip seal 100 can be lubricated with graphite powder. Additionally, the size of the dampening mechanism can be chosen by the designer to provide the desired functionality and performance.

Figure 8:
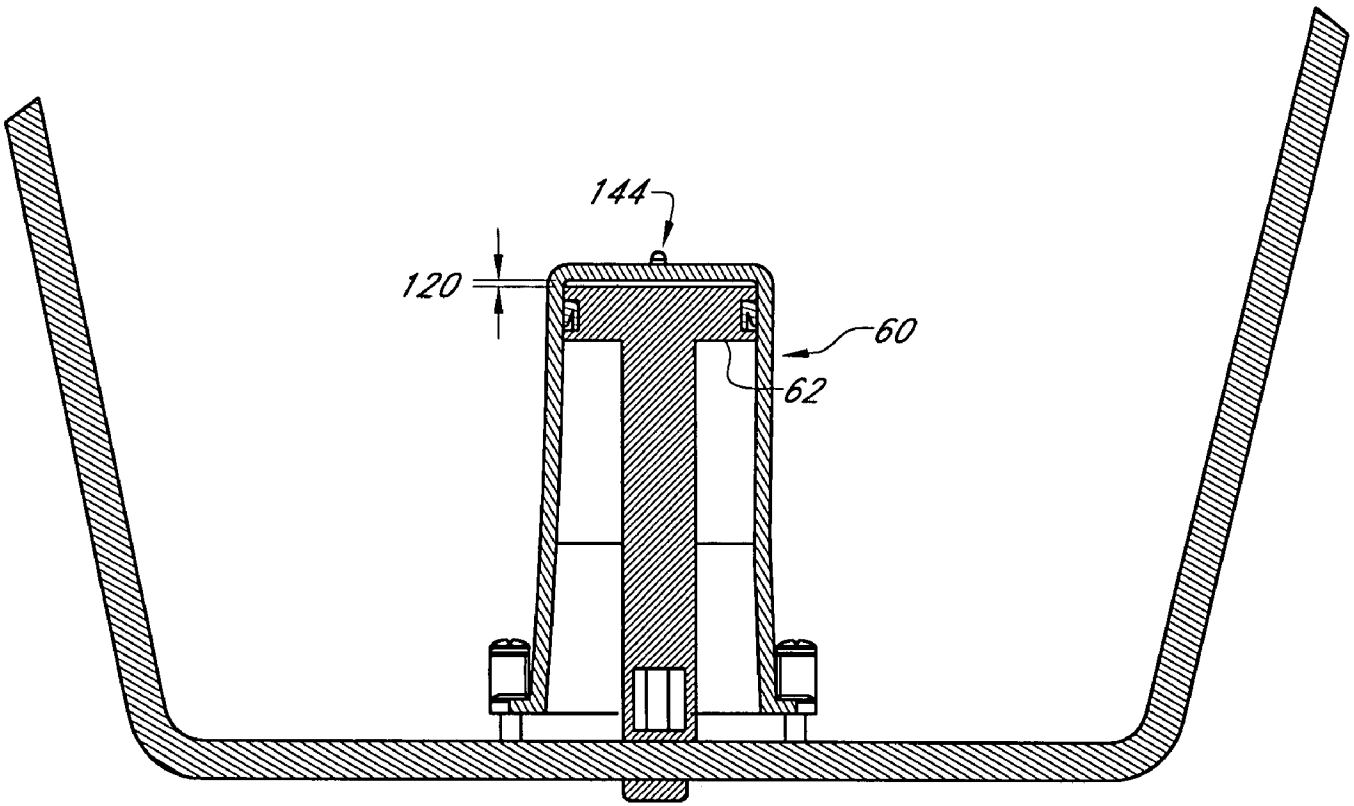
FIG. 8 is a sectional view of the damper showing the damper in a position corresponding to when the lid is opened to its maximum opened position.

For example, with reference to FIG. 8, the height of the housing, which determines the length of the maximum vertical movement of the piston 62 within the housing, can be chosen to correspond to the maximum vertical displacement of the rear end of the pedal bar 50. Additionally, the diameter of the housing 60 and the type of lip seal 100 used affects the resistance generated during the downward movement of the piston 62. Thus, these dimensions can be chosen to provide the desired dampening characteristics.

Additionally, further advantages are achieved where the size of the housing 60 and the position at which the housing 60 is mounted within the receptacle 20 can be adjusted to provide desired characteristics of the motion of the lid 28 during its closing movement. For example, it has been found that if the housing 60 is mounted in a position where the piston 62 is space excessively far from the top of the housing 60 when the piston 62 is at its maximum vertical position, the lid 28 can move too quickly from its fully opened position towards its closed position.

However, if a mounting position of the housing 60 is adjusted so that the piston 62 is closely spaced relative to the top of the housing 60 when the piston 62 is at its maximum upper position, the movement of the lid 28 the damper provides additional dampening, at least initially, thereby providing a slower, more aesthetically pleasing motion.

For example, by adjusting the position of the housing 60 such that a spacing between the piston 62 and the top of the housing 60 when the piston 62 is at its maximum position, when the foot pedal 48 is released, the lid 28 can begin to move very slowly initially, and slowly accelerate to an acceptably slow closing speed, such that the lid 28 does not make an excessively loud noise when it finally comes to rest against the frame 30. In some embodiments, the spacing 120 can be equal to or less than about 10% of the total movement of the piston. The initial movement piston 62 is further slowed if the spacing 120 is about 5% or less of the total movement of the piston 62. Finally, mounting the housing such that the spacing is about 4% or less of the total movement of the piston provides further slowing, and thus achieves a more aesthetically pleasing movement.

In an exemplary but non-limiting embodiment, where the inner diameter of the housing 60 is about 35 mm and the maximum movement of the piston 62 is about 53 mm, the housing 60 can be adjusted so the maximum vertical position of the piston 62 results in a minimum spacing 120 between the top of the piston 62 and the lower surface of the top of the housing 60 is only about 2 mm, i.e., about 4% of the total vertical movement of the piston 62. With this spacing, the lid 28 begins to move slowly when the pedal 48 is released, and slowly accelerates to an acceptably slow closing speed.

A designer can choose the appropriate housing, piston, and lip seal combination to achieve the desired closing speed. Thus, in some embodiments, at least one of the lid 28, housing 60, piston 62, lip seal 100, pedal bar 50, and pivot axis 54 can be configured to achieve the desired closing speed. For example, a combination of these components can be configured to achieve a closing speed of no more than about 10 seconds. In other embodiments, these components can be configured to achieve a closing speed of no more than about 5 seconds. In still further embodiments, these components can be configured to provide a closing speed of about 2 to 4 seconds. However, any desired closing speed can be used.

With reference again to FIG. 1 and FIG. 2B, another advantage of mounting the housing 60 to the base 52 is that the top of the housing 60 is oriented at a position that can be utilized for holding the liner (FIGS. 9 and 10) at a position for facilitating the insertion into or removal of a bag from the liner.

Figure 10:
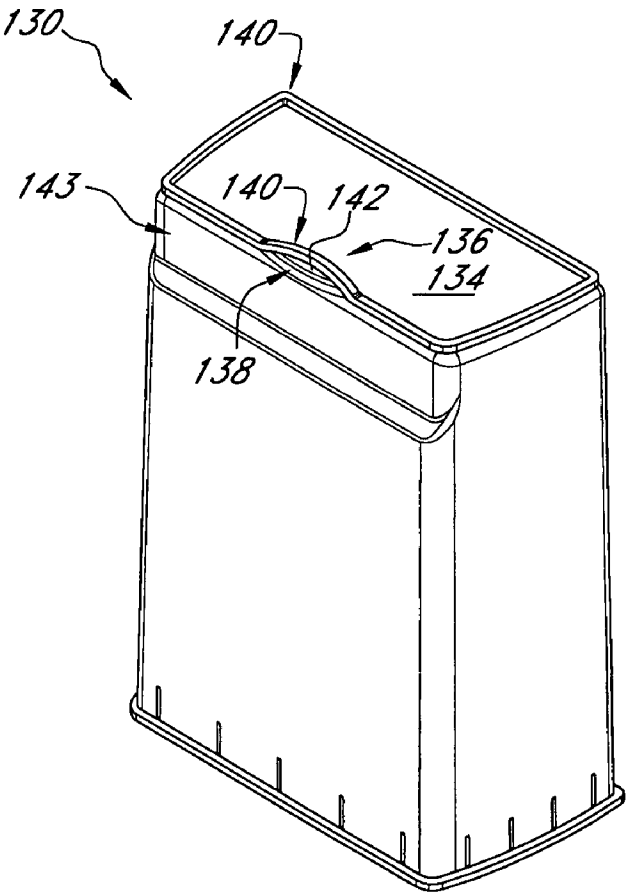
FIG. 10 is a bottom, rear, and right side perspective view of the liner of FIG. 9.
Figure 9:
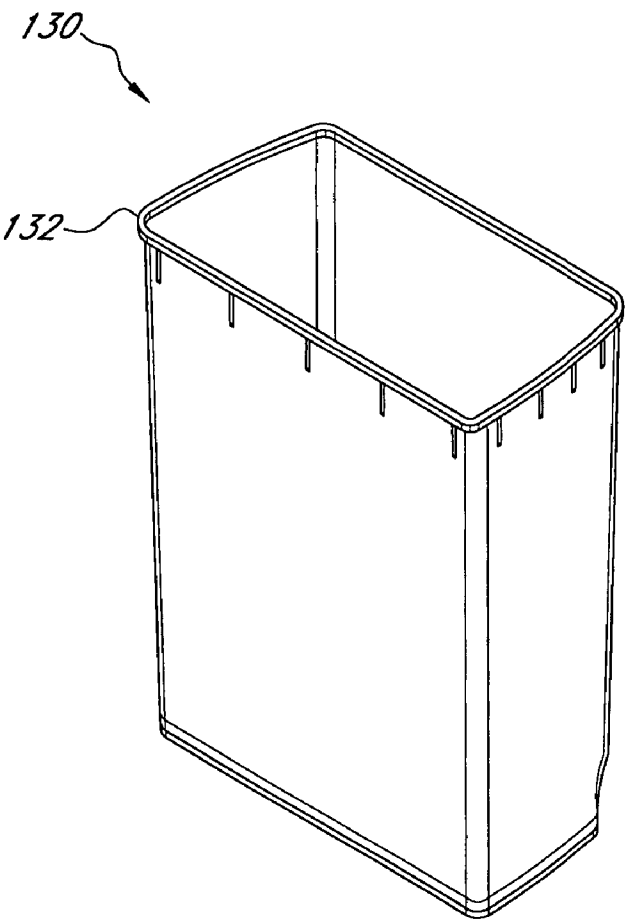
FIG. 9 is a top, front, and left side perspective view of a liner that can be used with the receptacle assembly.

With reference to FIGS. 9 and 10, a liner 130 can have a shape that is generally complimentary to the shell 22. In the illustrated embodiment, the liner 130 includes an upper flange 132 that is configured to support the weight of the liner 130 from the frame 30.

With reference to FIG. 10, the liner 130 includes a lower wall 134. In some embodiments, at least a rearward portion 136 of the rear wall 134 is configured to rest on the housing 60. For example, in some embodiments, a rear portion 136 of the lower wall 134 can be flat, curved, sloped, etc.

Optionally, the rear portion 136 can include other features for more actively engaging the top of the housing 60. For example, as shown in FIG. 10, the rear portion 136 includes a raised outer lip portion 138. Additionally, a periphery of the lower wall 134 includes a raised peripheral wall 140. In the vicinity of the rear portion 136, the raised lip 138 is spaced from the wall 140 so as to define a recess 142 between the raised lip 138 and the raised wall 140. As such, the liner 130 can be configured to more actively engage the housing 60. In some embodiments, the liner can be configured to engage an additional feature on the housing 60.

For example, as shown in FIG. 1, the housing 60 can include a projection 144. The projection 144 can have any shape. In the illustrated embodiment, the projection 144 extends upwardly from the top of the housing 60. Additionally, the projection 144 can include a generally hemispherical tip. However, any configuration can be used.

Figure 11:
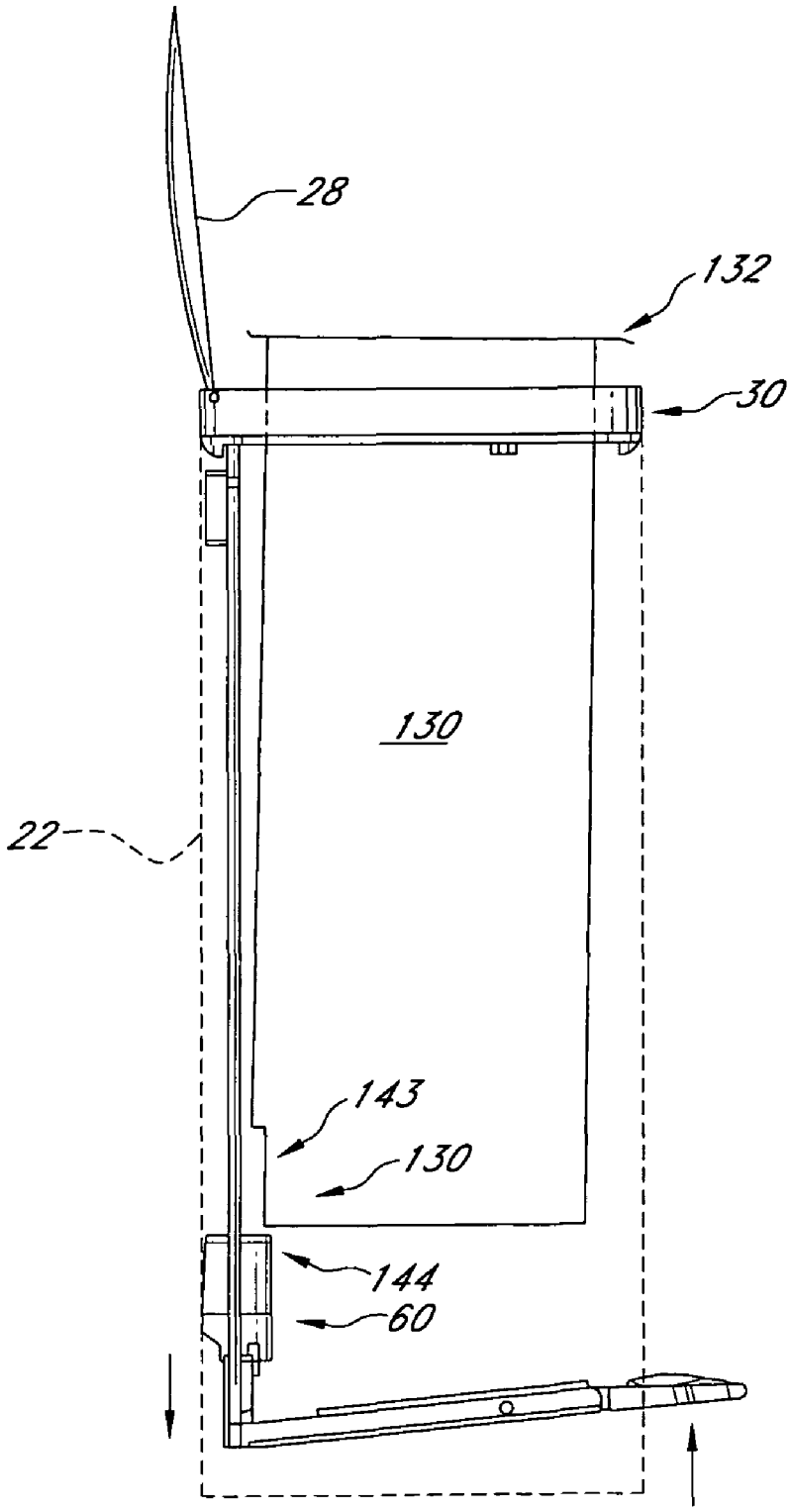
FIG. 11 is a left side elevational view of the receptacle assembly illustrating an optional use for the damper mechanism in which the liner is held at an elevated position within the shell (illustrated in phantom).
Figure 12:
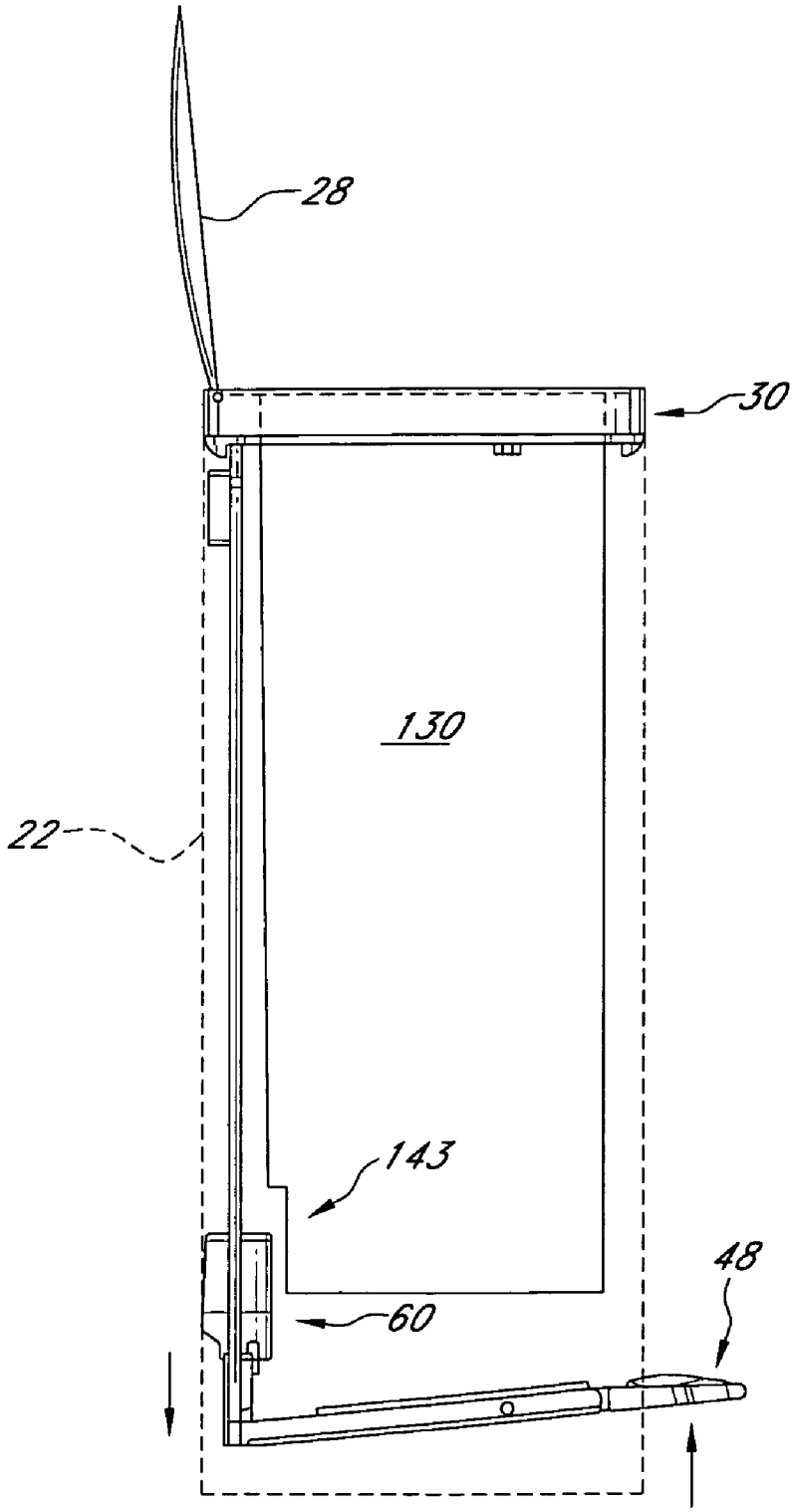
FIG. 12 is a right side elevational view of the receptacle assembly showing the liner fully seated within the shell (shown in phantom).

With reference to FIG. 11, the liner 130 can be inserted most of the way into the shell 22, leaving the rear portion 136 on top of the housing 60. In this position, a bag (not shown), which may be a thin trash bag commonly used in this art, can be more easily inserted and engaged with the flange 132 of the liner 130. After the upper edge of the trash bag is engaged with the flange 132, the liner 130 can be lifted off of the housing 60 and dropped into its resting position within the shell 22, as shown in FIG. 12.

Additionally, when such trash bag is full, the liner 130 can be lifter to the raised position (FIG. 11). In this position, a portion of the trash bag folded over the flange 132 can be more easily removed so that the user can lift the trash bag out of the liner 130. As such, the rash bag can be easily removed from the liner 130 without having to remove the liner 130 from the shell 22.

With reference again to FIG. 11, the recess 142 can be engaged with the projection 144 so as to more easily and securely hold the liner 130 in the slightly raised position illustrated in FIG. 11. As such, the liner 130 is more securely held in the raised position illustrated in FIG. 11.

Finally, the liner 130, in some embodiments, can include an additional recess 143 configured to provide additional clearance for the housing 60. The recess 143 can have any shape. In the illustrated embodiment, the recess 143 extends across the lateral width of the liner 130 (FIG. 10).

Figure 13:
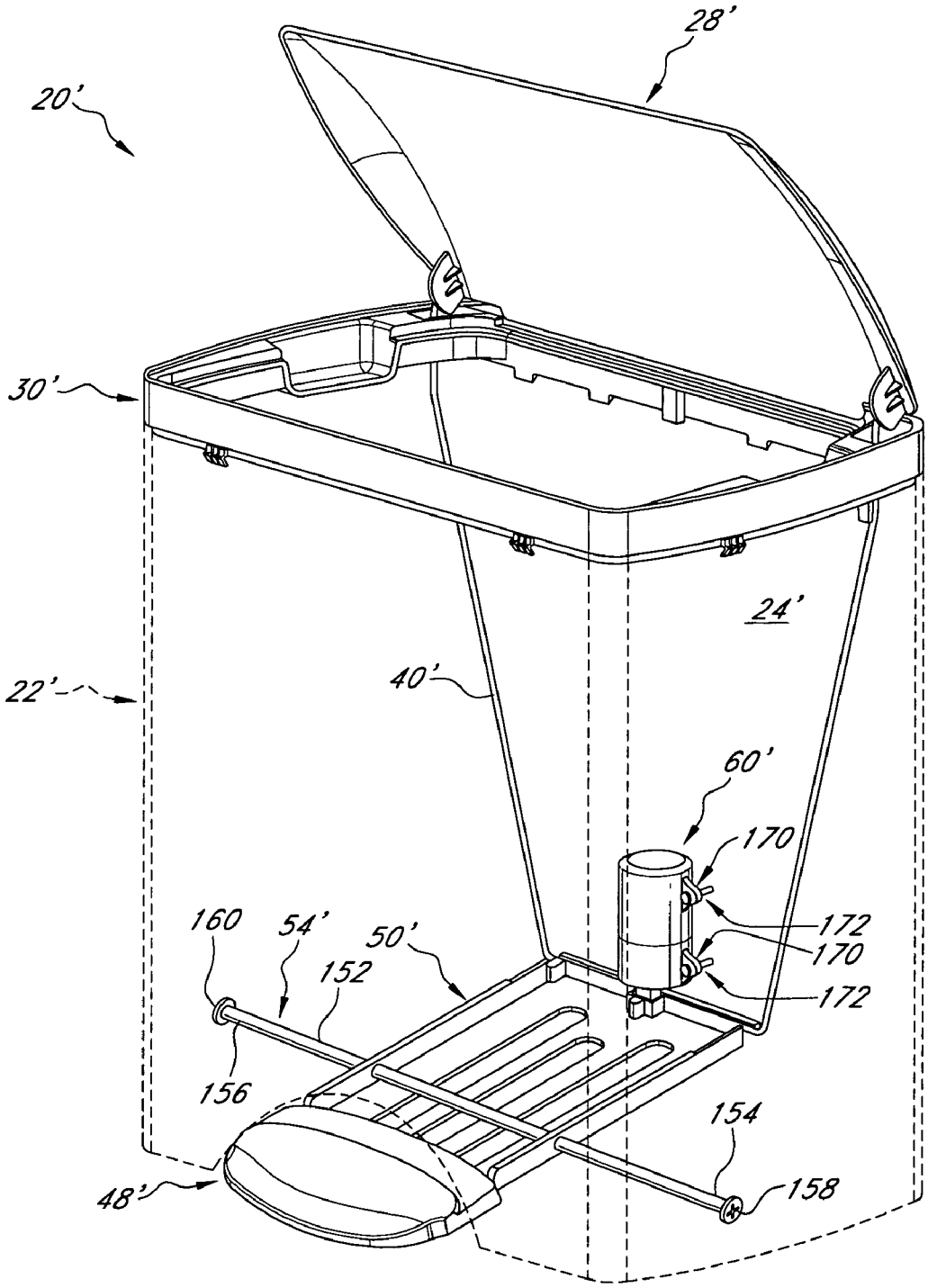
FIG. 13 is a front, top, and left side perspective view of a modification of the receptacle assembly of FIGS. 1-12, with the outer shell shown in phantom line.
Figure 14:
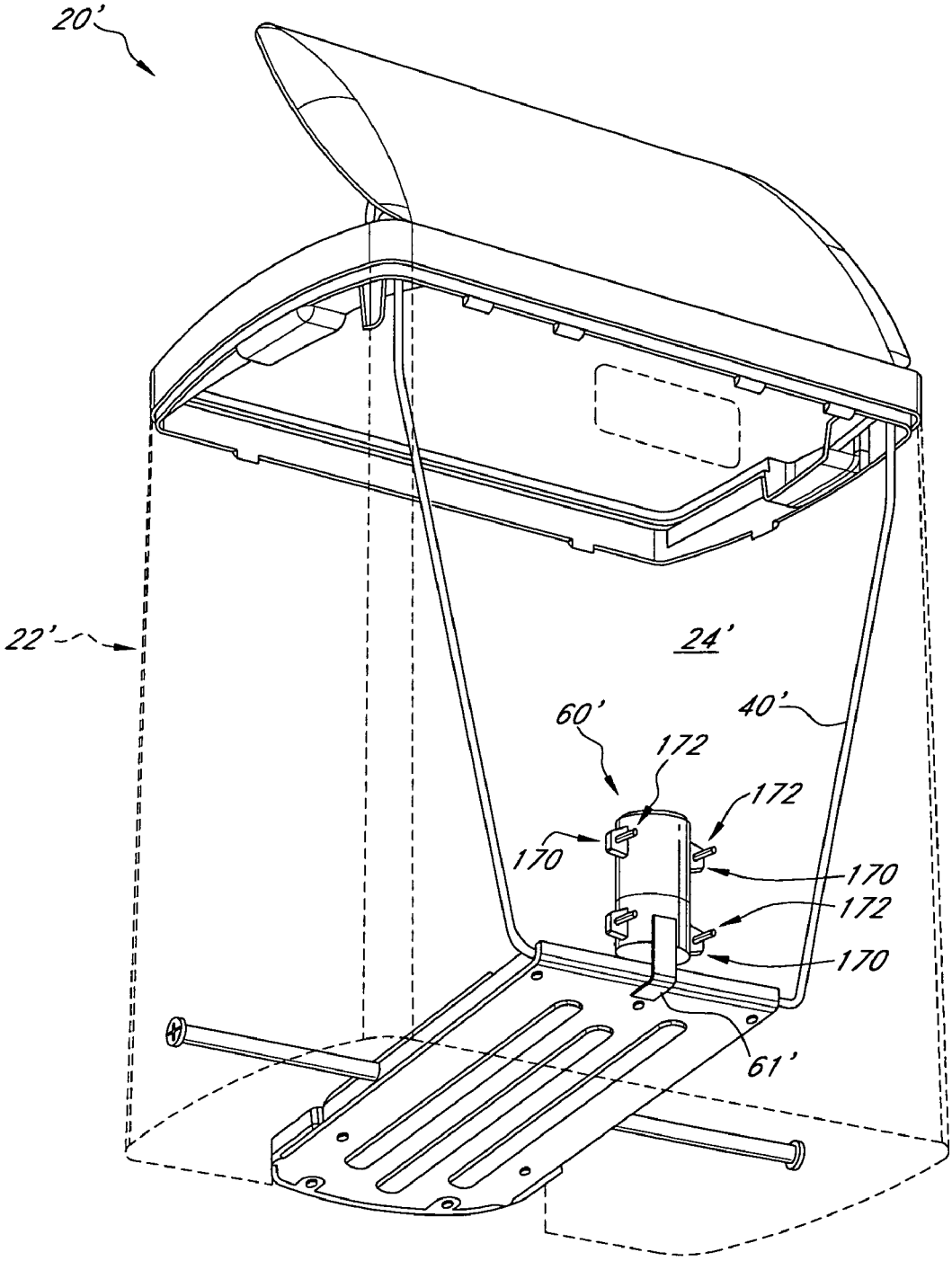
FIG. 14 is a bottom, rear, and left side perspective view of the receptacle assembly illustrated in FIG. 13.

With reference to FIGS. 13 and 14, a modification of the receptacle assembly 20 is illustrated therein and identified generally by the reference numeral 20'. Components and features of the receptacle assembly 20 described above that are similar or the same as the components of the receptacle assembly 20' are identified below using the same reference numerals, except that a "'" has been added thereto. Thus, a full description of such components is not repeated herein. Thus, these components can be assumed to be the same or similar to those described above with reference to the receptacle assembly 20.

As noted above, with reference to the receptacle assembly 20, the base 52 (FIG. 2B) is optional. As shown in FIGS. 13 and 14, the shell 22' does not include a separate base portion. Rather, the material forming the shell 22' is configured to support the receptacle assembly 20' on a floor surface. Optionally, the shell 22' can be reinforced along its lower edge. For example, the shell 22' can be thicker along its lower edge so as to provide additional stiffness in the lower portion thereof. In some embodiments, where the shell 22' is made from a sheet material, the lower edge can be folded over so as to make the lower edge of the shell 22' thicker and stiffer than the central portions of the shell 22'. However, other configurations can also be used.

Thus, the shell 22' provides all of the structural support for the lid 28' and upper support frame 30', as well as the pedal bar 50', the damper 60', and the pivot axis 54'. However, as noted above, the receptacle assembly 20' can also include a base portion such as the base portion 52.

As shown in FIG. 13, the pedal bar is pivotally mounted about the pivot axis 54'. The pivot axis 54' can be defined by a pivot shaft 152 having left and right ends 154, 156 supported by the shell 22'. The shaft 152 can extend through apertures defined in the pedal bar 50' so as to pivotally support the pedal bar 50'.

In the illustrated embodiment, the left and right ends 154, 156 include threaded apertures (not shown) into which threaded fasteners 158, 160 engage so as to secure the pivot shaft 152 in place. For example, the shell 22' can have apertures (not shown) through which the threaded ends of the fasteners 158, 160 extend, leaving the enlarged heads of the fasteners 158, 160 exposed on the outer surface of the shell 22'. However, this is merely one configuration that can be used. The shaft 152 can be supported with other arrangements from the shell 22', or with other devices separate from or connected to the shell 22'.

As shown in FIG. 14, the lower end of the piston rod 61' is attached to a lower portion of the lifting rods 40'. In the illustrated embodiment, the damper 60' is supported by the rear wall 24' of the shell 22'.

In some embodiments, the damper 60' can include a plurality of flanges 170 configured to support the damper 60' from another surface. In the illustrated embodiment, the damper 60' includes four flanges 170 extending from the lateral sides of the outer housing of the damper 60'. This arrangement provides enhanced stabilization for the damper 60', thereby better absorbing torques that can be applied to the damper 60' during movement of the pedal bar 50'.

In some embodiments, threaded fasteners 172 can be used to secure the flanges 170 relative to the rear wall 24'. In some embodiments, the threaded fasteners can be provided with spacers to maintain the spacing between the rear wall 24' and the rear face of the flange 170.

The threaded fasteners 172 can be attached to the rear wall 24' in any known manner. For example, the rear wall 24' can include threaded studs (not shown) mounted to the inner surface rear wall 24' and configured to receive the threaded portion of the fasteners 172. In other embodiments, the threaded fasteners 172 can be sized to extend through apertures (not shown) formed on the rear wall 24' so as to allow nuts or other devices to be engaged with the ends of the threaded fasteners 172 to thereby secure the flanges 170 relative to the rear wall 24'. However, any other technique can be used for mounting the damper 60' relative to the rear wall 24'. Further, the damper 60' can be mounted relative to other portions of the receptacle assembly 20'.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A receptacle having a lid, the receptacle comprising:

a receptacle body member defining a cavity configured to contain objects, the cavity including an opening;

a lower portion configured to support the receptacle body on a floor;

a lid mounted relative to the opening and configured to be moveable between open and closed positions;

a lid operation mechanism configured to allow a user to move the lid between the open and closed positions, the lid operation mechanism comprising a user input member mechanically interfaced with the lid so as to allow a user to at least open the lid through manipulation of the user input member;

a fluid damper mechanism configured to dampen the movement of the lid from the open position to the closed position, the damper mechanism comprising a housing secured and stabilized to the lower portion.

2. The receptacle according to claim 1, wherein the lower portion comprises a base of the receptacle, the damper mechanism being connected directly to the base.

3. The receptacle according to claim 2, wherein the user input member is supported by the base.

4. The receptacle according to claim 3, wherein the user input member is pivotally supported by the base.

5. The receptacle according to claim 1, wherein the housing comprises a cylinder member, and the damper mechanism further comprises a piston configured to reciprocate within the cylinder, the cylinder member being connected directly to the lower portion.

6. The receptacle according to claim 5, wherein the user input member comprises a foot pedal and a lever arm extending across the base from a front of the receptacle to a rear of the receptacle, the lower portion including a pivotal mount for the lever arm.

7. The receptacle according to claim 6, wherein the lever arm is mounted such that its weight biases it towards a position corresponding to the closed position of the lid, the weight of the lid and the lever arm being sufficient to cause the lid to close against the dampening affect of the damper mechanism.

8. The receptacle according to claim 5, wherein the cylinder member and piston are configured such that the piston is located within last 5% of its movement into a closed end of the cylinder when the lid is in the open position.

9. The receptacle according to claim 1 additionally comprising a liner member shaped complimentary to the receptacle and configured to fit into the cavity, wherein the dampening mechanism housing has an upper end, the housing being positioned within the cavity such that the liner member can rest on the upper end of the housing with an upper end of the liner member extending upwardly out of the opening of the cavity.

10. The receptacle according to claim 1 additionally comprising a liner member shaped complimentary to the receptacle and configured to fit into the cavity, the damper mechanism having an upper portion configured to engage a lower portion of the liner member.

11. The receptacle according to claim 10, wherein the upper portion of the damper mechanism comprises a projection configured to engage the lower portion of the liner member.

12. The receptacle according to claim 11, wherein the lower portion of the liner member comprises a recess configured to engage the projection on the upper portion of the damper mechanism.

13. The receptacle according to claim 1 additionally comprising a resilient member configured to bias the lid toward the closed position.

14. A receptacle having a lid, the receptacle comprising:

a receptacle body member defining a cavity, the cavity including an opening;

a liner member shaped complimentary to the receptacle and configured to fit within the cavity;

a lid mounted relative to the opening and configured to be moveable between open and closed positions;

a lid operation mechanism configured to allow a user to move the lid between the open and closed positions; and a damper mechanism configured to dampen the movement of the lid from the open position to the closed position, the damper mechanism comprising a housing secured and stabilized to the receptacle body, the housing having an upper portion configured to support the liner member in a position with an upper portion of the liner member extending through the opening.

15. The receptacle according to claim 14, wherein the housing upper portion is configured to engage a lower portion of the liner member.

16. The receptacle according to claim 14, wherein the upper portion of the housing comprises a projection configured to engage a lower portion of the liner member.

17. The receptacle according to claim 16, wherein the lower portion of the liner member comprises a recess configured to engage the projection on the upper portion of the housing.

18. A receptacle having a lid, the receptacle comprising:

a receptacle body member defining a cavity configured to contain objects, the cavity including an opening;

a lower portion configured to support the receptacle body on a floor;

a lid mounted relative to the opening and configured to be moveable between open and closed positions;

a lid operation mechanism configured to allow a user to move the lid between the open and closed positions, the lid operation mechanism comprising a user input member mechanically interfaced with the lid so as to allow a user to at least open the lid through manipulation of the user input member; and means for restricting a fluid flow to dampen the movement of the lid from the open position to the closed position, the means for dampening comprising a housing secured and stabilized to the lower portion.

19. The receptacle according to claim 18, wherein the means for restricting additionally comprises means for supporting a liner shaped complimentary to the receptacle and configured to fit in the cavity.

20. The receptacle according to claim 18, wherein the lid operation mechanism comprises a lever arm extending from the user input member to the means for restricting, the lever arm being pivotally supported by the lower portion at a position between the user input member and the means for restricting.

21. The receptacle according to claim 20, wherein the lever arm is pivotally such that its weight is unbalanced and thereby biased toward a position corresponding to the closed position of the lid.

22. The receptacle according to claim 20, wherein the weight of the lever arm is sufficient to pull the lid from the open position to the closed position against the resistance of the means for restricting, within about 5 seconds.

* * * * *

UNITED STATES PATENT AND TRADEMARK OFFICE

CERTIFICATE OF CORRECTION

PATENT NO. : 7,922,024 B2
APPLICATION NO. : 11/475349
DATED : April 12, 2011
INVENTOR(S) : Yang et al.

It is certified that error appears in the above-identified patent and that said Letters Patent is hereby corrected as shown below:

In Column 5, Line 35, change “the position,” to --the open position,--.

In Column 6, Line 45, after “wall” delete “of”.

In Column 10, Line 63, in Claim 7, change “affect” to --effect--.

Signed and Sealed this
Thirteenth Day of March, 2012

David J. Kappos

David J. Kappos
*Director of the United States Patent and Trademark Office*